United States Patent [19]

Featherstone

[11] 4,203,567

[45] May 20, 1980

[54] COLLAPSIBLE TUBE HOLDING BRACKET

[76] Inventor: Ivy Featherstone, 3024 Hudson St., Columbus, Ohio 43219

[21] Appl. No.: 942,384

[22] Filed: Sep. 14, 1978

[51] Int. Cl.[2] ..... B65D 35/56

[52] U.S. Cl. ..... 248/108; 222/105; 222/181

[58] Field of Search ..... 24/67.7; 222/103, 105; 248/108, 109, 113

[56] References Cited

U.S. PATENT DOCUMENTS

| | | | |
|---|---|---|---|
| 1,481,236 | 1/1924 | Spine et al. | 248/108 X |
| 2,880,911 | 4/1959 | Robertson | 222/105 |
| 3,101,869 | 8/1963 | Baker | 248/108 X |

*Primary Examiner*—James C. Mitchell

*Attorney, Agent, or Firm*—W. Britton Moore

[57] ABSTRACT

A collapsible tube holding bracket for retaining a tube vertically relative to a wall surface including a flat supporting plate adjustably and removably adhered to a wall surface and having a spring pressed clip for clamping the inverted lower end of a tube so that it depends therealong. An L-shaped apertured bracket is adjustably spacedly supported on the plate below the clip and receives the reduced dispensing tube neck therein to retain the tube vertically on and in engagement with the plate and enables the closure cap to be arranged thereon. With the cap removed and a brush disposed therebeneath, the application of hand pressure against the tube forces it against the plate and squeezes paste onto the brush.

2 Claims, 5 Drawing Figures

COLLAPSIBLE TUBE HOLDING BRACKET

This invention relates to a collapsible tube holding bracket including a flat wall supported plate having a spring pressed clip and an L-shaped outlet end supporting bracket spacedly arranged thereon whereby the simple application of hand pressure against the tube squeezes paste therefrom onto a brush disposed therebeneath.

While it has heretofore been proposed to support collapsible tubes relative to a wall surface so that when squeezed paste will be dispensed therefrom, such as, for example, those represented by U.S. Pat. Nos. to Hartland 2,064,111, Oursler 2,340,681, Snaith 2,711,269, and Hornsby 2,801,770, such devices are relatively complex and usually require the inclusion of pressure applying plate means for effecting discharge of the paste therefrom. Such requirements increase the cost of these devices and are otherwise objectionable because it is not possible to fully discharge the supply of paste therefrom.

The principal object of the present invention is to provide a collapsible tube holding bracket including a flat supporting plate removably and adjustably adhered to a wall surface and having a spring pressed clip and a L-shaped apertured outlet end supporting bracket spacedly and adjustably arranged thereon whereby the tube is so retained thereon that hand pressure thereagainst forces the tube against the support plate and expels paste therefrom.

Another object is the provision of a flat supporting plate with adhesive means on the back thereof for removable adherence to a wall surface.

Still another object is to provide a spring pressed clip at one end of the flat supporting plate and readily expandable by finger pressure to enable an end of a collapsible tube to be clamped therein.

A further object is the provision of an L-shaped apertured outlet end supporting bracket spacedly, removably and adjustably adhesively supported on the supporting plate below the clip for retaining the outlet end of the tube in discharging position relative to the plate, and which is vertically adjustable as the contents are exhausted.

Still a further object is to provide a very simple and inexpensive collapsible tube holding bracket including only three component parts.

These and other objects and advantages will be apparent as the specification is considered with the accompanying drawings, wherein FIG. 1 is a perspective view of the tube holding bracket with tube clamped thereon;

Figure 1:
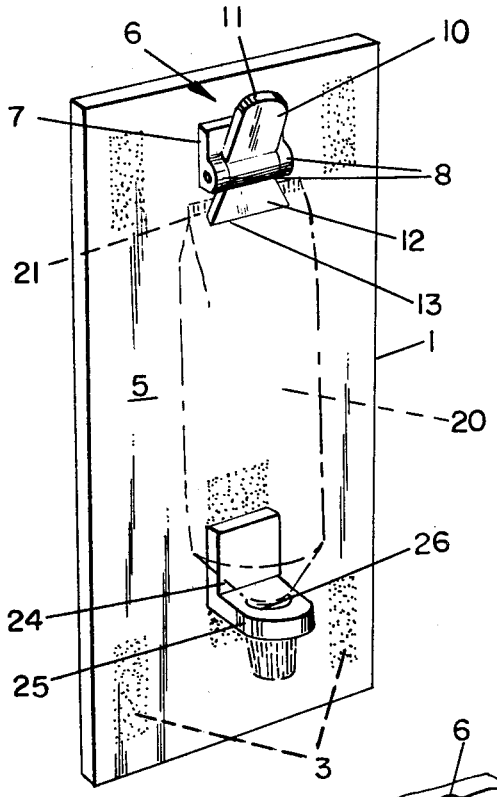
Figure 2:
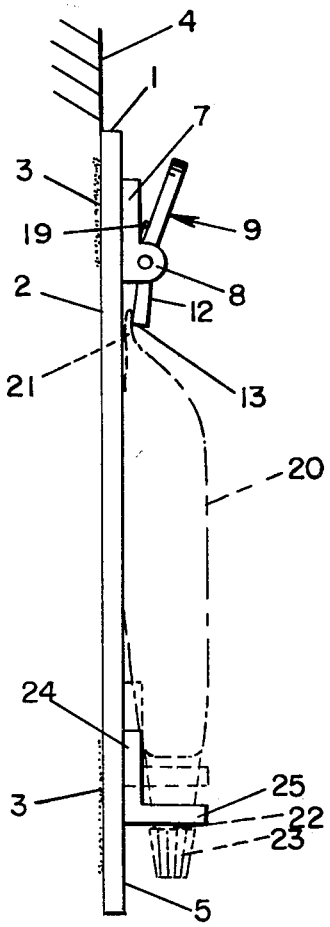
FIG. 2 is a side view of the bracket with tube clamped thereon.
Figure 3:
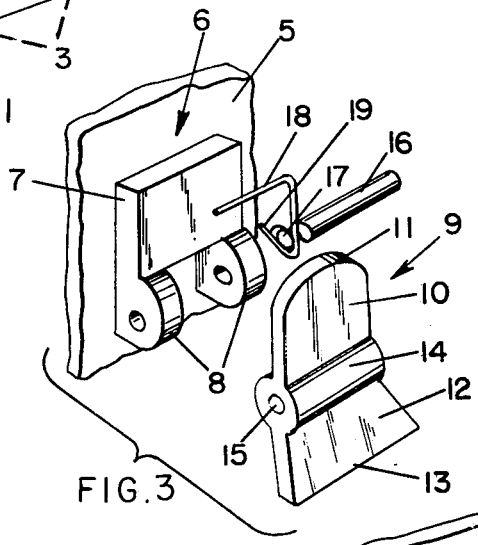
FIG. 3 is an exploded view of the spring pressed clip.

Referring more particularly to the drawings, wherein similar reference characters designate like parts throughout the several views, numeral 1 generally identifies a flat, substantially rectangular plate having spaced adhesive areas or tapes 3, of some suitable tacky adhesive, on a flat rear face 2 thereof to enable the plate to be removably and adjustably adhered to a flat wall surface 4.

Suitably fixedly attached to the flat front face 5 of the plate 1, at a point midway between the side edges and spaced below the upper edge thereof, is a clip 6 which includes a flat base 7 with spaced upstanding apertured ears or bearings 8 at the lower edge thereof. The clip also embodies a clamping element 9 with an upstanding flat tongue 10 rounded, as at 11, at its upper edge and projecting downwardly and thence outwardly at a slight angle and being flared, as at 12, to provide an abrupt transverse clamping edge 13. Clamping element 9 is bulged intermediate its ends, as at 14, and is formed with a transverse bore 15 therethrough so that, when the bulged mid section is fitted between the ears 8 of base 7, a retaining pin 16 is projectable therethrough to pivotally mount the clamping element thereon. A coiled wire return spring 17 is sleeved on pin 16 and is provided with a laterally bent upper end 18 and a rearwardly projecting lower end 19. As the upper end 18 extends between base 7 and the rear face of tongue 10, outward spring pressure is applied thereto to pivot the clamping edge 13 rearwardly toward the flat plate 1.

The inverted closed or sealed lower end 21 of a conventional collapsible tube 20, filled with toothpaste or the like, may be positioned under the clamping element 9, when inward pressure is applied to the tongue 10 thereof, whereupon release of pressure snaps the clamping edge 13 thereagainst and serves to clamp the sealed end 21 of the tube against the flat front face 5 of the plate 1. As tubes of this type are provided with a threaded reduced outlet neck 22 having a closure cap 23 threaded thereon, the neck is extendable through an aperture 26 in a forwardly projecting flat arm 25 of an L-shaped bracket 24. The flat rear wall 27 of bracket 24 may adhesively engage a suitable tacky adhesive strip or area 28 on the front face 5 of plate 1, or the rear wall 27 may be provided with a suitable tacky adhesive, so as to be selectively adhered to the face of the plate, in an obvious manner. Thus, when a filled tube is first clamped on the plate with suspended outlet end downwardly thereon, the bracket 24 will retain the tube in position.

If desired, the tacky adhesive strip 28 may be replaced by a magnetic tape or plate, not shown, in which event, the flat rear wall 27 of bracket 24 may be similarly equipped with a magnetic tape or plate to effect adjustment and/or relocation of the bracket, as will be readily apparent.

When it is desired to dispense paste from the tube and apply the same to the brush 30 of a toothbrush 29, the cap 23 may be removed and the brush 30 disposed beneath the outlet neck 22. Inward pressure of a hand against the wall of the tube 20 presses the latter against the flat front wall of plate 1 and squeezes paste therefrom onto the brush, after which the cap is reapplied for subsequent use. As the supply of paste is used from the tube, the sealed end 21 thereof may be removed from the clamp and that end of the tube wound to reduce the length of the tube, so that the L-shaped bracket 24 may be removed and relocated closer on the supporting plate to the clamped end. This enables the tube to be securely supported as the supply of plate is exhausted therefrom, and insures of the tube being completely emptied.

Figure 4:
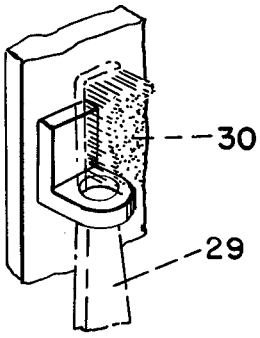
FIG. 4 is a perspective view of the clip when used to support a toothbrush therein when a tube is not clamped on the supporting plate.
Figure 5:
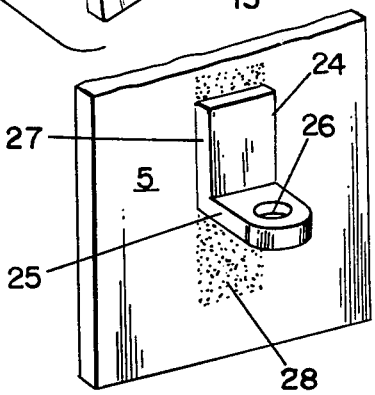
FIG. 5 is a perspective view of the clip and the manner in which it may be adjustably and removably adhered to the supporting plate.

After a tube has been emptied and removed from the clamp, the L-shaped bracket 24 may be utilized to support the toothbrush by introducing the handle thereof through aperture 26 in bracket arm 25, as shown in FIG. 4.

While a preferred embodiment of holding bracket has been shown and described, it is to be understood that various changes and improvements may be made therein without departing from the scope and spirit of the appended claims.

What I claim is:

1. A tube holding bracket for supporting a collapsible paste tube having one end sealed and a capped outlet discharge end on a walled surface comprising a flat supporting plate, spaced adhesive areas on a rear surface of said plate for adjustably and removably adhering said plate to said walled surface, spring pressed clip means on a front surface of said plate for clamping said sealed end uppermost thereon and suspending said tube thereon, said clip means including flat base means formed with forwardly extending spaced apertured ears, an upstanding and angularly extending flat tongue on said clip means insertable between said ears and having a transverse bore therethrough alignable with said apertured ears for pivoting said tongue on said base means, said tongue having a lowermost clamping edge thereon, spring means on said pin means and engageable with said tongue for holding said clamping edge in clamping engagement with the sealed end of said tube, and generally L-shaped bracket means on said supporting plate spaced below said clip means and having an aperture therein for receiving and supporting said outlet discharge end therein, said bracket having a flat vertical portion and a flat horizontal portion with said aperture being formed in said horizontal portion, the rear face of said flat vertical portion being adhesively coated for removably and adjustably supporting said bracket on said plate relative to said clip means as hand pressure is applied against said clamped tube to discharge paste therefrom.

2. A tube holding bracket according to claim 1, wherein the handle of a brush is insertable in the aperture of said L-shaped bracket means for supporting the brush when a collapsible tube is not clamped on said supporting plate.

* * * * *